US006200000B1

(12) United States Patent
Burnidge

(10) Patent No.: US 6,200,000 B1
(45) Date of Patent: Mar. 13, 2001

(54) ILLUMINATING INSERT FOR A CARRIER FOR ARTICLES SUCH AS JACK-O-LANTERNS AND THE LIKE

(76) Inventor: Lane E. Burnidge, 5N916 Sunset, Maple Park, IL (US) 60151

( * ) Notice: Subject to any disclaimer, the term of this patent is extended or adjusted under 35 U.S.C. 154(b) by 0 days.

(21) Appl. No.: 09/273,962

(22) Filed: Mar. 22, 1999

(51) Int. Cl.[7] ..... F21V 33/00

(52) U.S. Cl. ..... 362/155; 362/109; 362/249; 362/251; 362/800; 362/806

(58) Field of Search ..... 362/249, 251, 362/252, 154, 156, 109, 800, 809

(56) References Cited

U.S. PATENT DOCUMENTS 4,414,525 * 11/1983 Garrabrants ..... 337/92
4,698,732 * 10/1987 Hickey ..... 362/154
4,714,985 * 12/1987 Hickey ..... 362/154
4,802,071 * 1/1989 Schuster ..... 362/154
5,175,528 * 12/1992 Choi et al. ..... 340/331
5,597,230 * 1/1997 Newman ..... 362/154
5,984,754 * 11/1999 Freelander ..... 446/73

* cited by examiner

*Primary Examiner*—Sandra O'Shea
*Assistant Examiner*—John Anthony Ward
(74) *Attorney, Agent, or Firm*—William C. Grabarek

(57) ABSTRACT

An illuminated plastic treat carrier, such as a Jack-o-lantern, having an insert with a handle activated switch that activates the lights when the carrier is lifted by the handle. The insert is mounted inside the carrier and has one or more incandescent lamps or light emitting diodes in series or parallel circuit with a dry cell battery and a switch mechanism formed at one end of the handle. Additionally, a bimetallic or solid state flashing unit may be incorporated into the light circuit.

14 Claims, 2 Drawing Sheets

ILLUMINATING INSERT FOR A CARRIER FOR ARTICLES SUCH AS JACK-O-LANTERNS AND THE LIKE

BACKGROUND OF THE INVENTION

1. Field of the Invention

The present invention relates to carriers for articles such as Halloween treats and the safety issues relating to trick or treating.

2. Description of Related Art

Typically, the tradition of trick or treating at Halloween is done at dusk and into the night when the danger to a child not being seen by approaching motor vehicles is greatest. To minimize this danger, the child is often required to carry a flashlight or battery powered lantern to warn drivers of motor vehicles of the child's presence. For younger children, this method is burdensome, as the child is required to carry both a container for carrying the collected treats and a flashlight or lantern and the degree of safety for the child is thereby diminished. Additionally, novel carriers are generally sought by children and their parents, especially those that provide safety features, such as illumination.

Various lighting means for treat-carrying jack-o-lanterns and the like have been developed in the past to overcome the shortcomings of carrying both a flashlight or battery powered lantern and a trick or treat bag or container. U.S. Pat. Nos. 4,698,732 and 4,714,985, for example, describe carriers for treats and other articles which have single and double bottoms and which employ a flashlight insert which must be manually switched on to illuminate the container and, thereby, allow approaching motor vehicles to see the child. Not only are these lighting means cumbersome and heavy, the typical flashlight batteries will drain in a relatively short period of time, leaving the means without illumination, unless the child turns off the flashlight when he or she is not walking in the roadway. U.S. Pat. No. 4,802,071 describes a lantern candy carrier which employs a battery powered light source which must be manually switched on and off. Again, the same shortcomings of the lighting means described in the prior two patents are present in this invention. U.S. Pat. No. 4,926,296 describes another attempt to provide a battery powered, illuminated carrying bag for transporting articles. This lighting means, however, has no manual switch mechanism. Instead, the batteries are inserted to activate the light bulbs. To prolong battery life, the child would be required to remove the batteries, clearly a difficult task for a young child. Lastly, U.S. Pat. No. 5,597,230 describes an ornamental carrier with flashlight-type eyes employing a manual switch in a rigid handle. This lighting means provides only uni-directional lighting and fails to provide adequate warning of the child's presence to an approaching motor vehicle unless the face of the ornamental carrier is pointed toward the motor vehicle.

Although these prior art lighting means provide children with some degree of safety at night, as well as novelty, their shortcomings are overcome in the present invention.

BRIEF SUMMARY OF THE INVENTION

It is a general object of the present invention to provide an illuminating means with a carrying handle for insertion into and securing within a shaped hollow plastic shell useful for carrying articles. It is a more particular object of the present invention to provide an improved illuminating means which employs a lift actuated electrical switch in conjoint use with the carrying handle for insertion into and securing within a shaped hollow plastic shell useful for carrying articles. It is a still more particular object of the present invention to provide an improved illuminating means wherein the illuminating means comprises one or more incandescent lamps or light emitting diodes alone or in combination with each other, alternatively with one or more of such incandescent lamps or light emitting diodes extending above the opening of said shell and, additionally, in series with a flashing means and which illuminating means employs a lift-actuated electrical switch in conjoint use with the carrying handle for insertion into and securing within said shaped hollow plastic shell.

BRIEF DESCRIPTION OF THE DRAWINGS

The accompanying drawings, which are incorporated into and constitute part of this specification, illustrate the preferred embodiments of the invention, and together with the detailed description below, serve to explain the invention in greater detail.

DETAILED DESCRIPTION OF THE INVENTION

The following description is provided to enable anyone skilled in the art to make and use the invention and sets forth the best mode of the invention. Modifications to the invention will be readily apparent to those skilled in the art.

Figure 1:
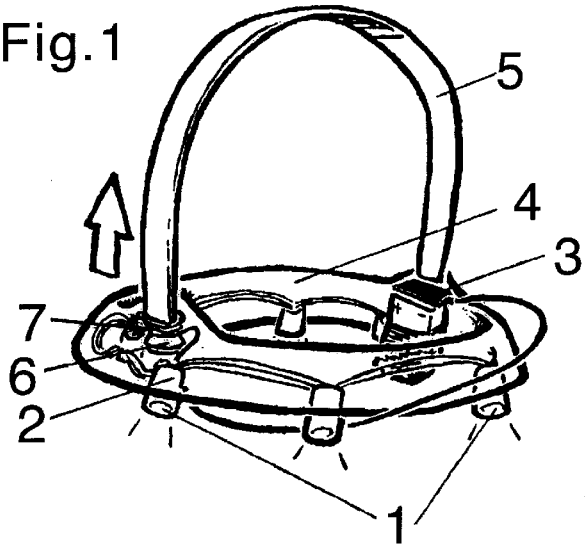
FIG. 1. is an isometric view of the illuminating means with the lift actuated electrical switch in conjoint use with the carrying handle.

In FIG. 1, a plurality of light emitting diodes or incandescent lamps 1, inserted into screw type or bayonet sockets 2, are wired in a circuit with one or more dry cell batteries 3 secured in a suitable holding means, and mounted on the underside of a truncated cone or spheroid shaped base of rigid or semi-rigid, and preferably, translucent or transparent plastic 4 to which one end of a rigid or semi-rigid plastic handle 5 is mounted on the upper side of the base and the other end of the handle is inserted through an opening in the base, said handle end having an electrical conducting material or contact 6 attached to and around the free end of the handle and to which the wire forming one side of the electrical circuit is attached. The truncation of the cone or spheroid has two protrusions on the upper surface which protrude beyond the edge of and into the opening of the shaped hollow plastic shell in which the base is to be inserted and secured. These protrusions are directly opposite of each other and are of sufficient size and area to allow mounting of the fixed end of the handle on one protrusion and provide an opening of sufficient size on the other protrusion to allow the free end of the handle to be inserted and slide without binding. The free end of the handle should be of such length to protrude through such opening and extend below the underside of the base a sufficient distance to allow the electrical circuit to be broken when there is no lifting of the handle. Between the underside of the base and the end of the free end of the handle on which the electrical conducting material or contact is attached is a circular shaped metal contact 7 fastened to the underside of the base and having an opening through which the handle is inserted. This metal contact 7 is attached to one end of the electrical wire forming the other end of the circuit to which the contact end of the handle is attached. The opening in the circular portion of this metal contact should be of sufficient size to allow the free end of the handle to slide within it without binding when the shaped hollow plastic shell, into which the illuminating means has been inserted and secured, is lifted by the handle, yet should have an inside diameter which is smaller than the outside diameter of the electrical conducting material or contact 6 attached to the free end of the handle to prevent the free end of the handle from passing through the inside diameter of metal contact 7. When the base has been secured to the inside wall of the shaped hollow plastic shell and the shell is lifted by the handle, the weight of the shell causes the electrical contacts 6 and 7 to touch completing the electrical circuit and powering the light emitting diodes or incandescent lamps thereby illuminating the inside walls of the shell.

Figure 2:
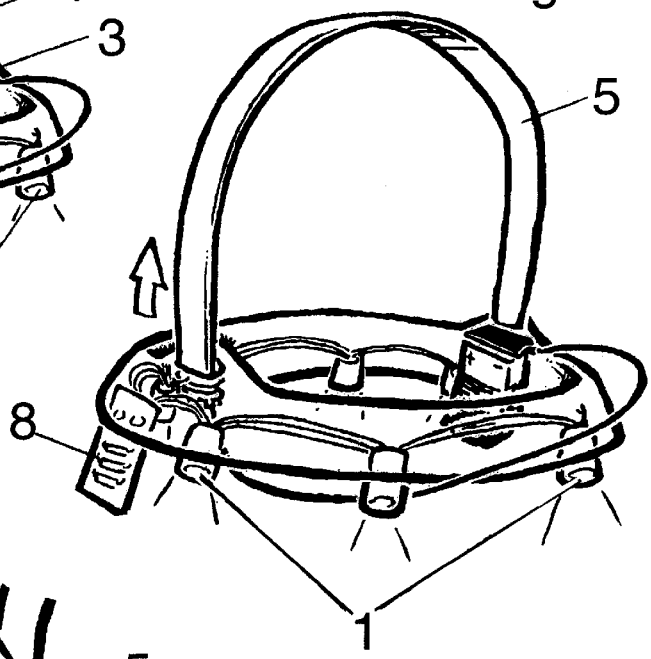
FIG. 2 is an isometric view of the illuminating means with an additional flashing means and a lift actuated electrical switch in conjoint use with the carrying handle.

FIG. 2 shows the addition of a flashing means 8 to the illuminating means shown in FIG. 1 in series with the electrical circuit which causes the light emitting diodes or incandescent lamps 1 to flash intermittently when the electrical circuit is completed by lifting the handle 5. Such flashing means are well known to those skilled in the art and usually are either a bimetallic element or solid state electronic circuit.

Figure 3:
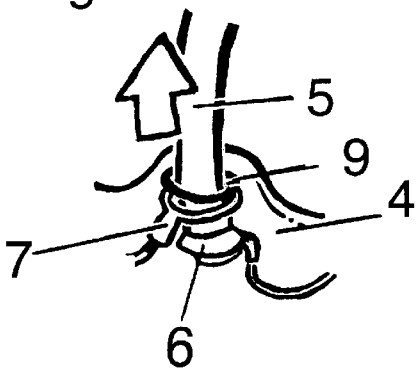
FIG. 3 is an fragmentary isometric view of the lift actuated electrical switch in conjoint use with the carrying handle.

FIG. 3 illustrates the handle switch mechanism in greater detail. The base 4 has an opening 9 of sufficient size to allow the handle 5 to slide without binding allowing electrical contact between the circular contact 7 and the contact ring 6 to be freely made when the shell is lifted by the handle 5. When the tension on the handle is relieved the electrical power to the light emitting diodes or incandescent lamps 1—1 is broken.

Figure 4:
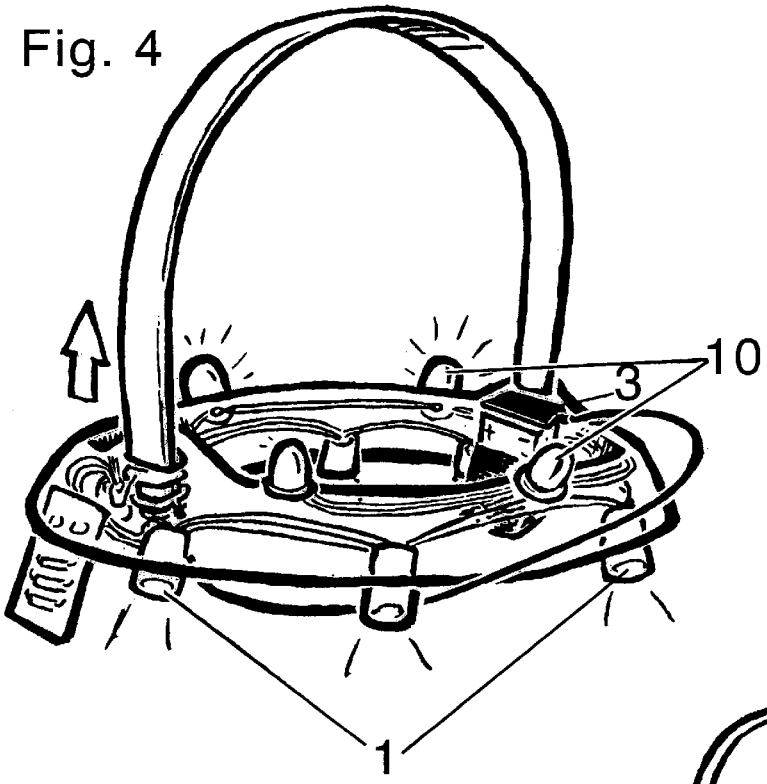
FIG. 4 is an isometric view of the illuminating means employing light emitting diodes in combination with a flashing means and the lift actuated electrical switch in conjoint use with the carrying handle, with additional light emitting means mounted on the top edge of the insert which, when the insert is inserted into and secured in a shaped hollow plastic shell, said additional light emitting means are clearly visible above the opening of said shell.

FIG. 4 shows the illuminating means illustrated in FIG. 2 wherein a plurality of additional light emitting diodes or incandescent lamps 10 are wired in circuit with the other light emitting diodes or incandescent lamps 1 and are aligned around and extend above the opening of the upper side of the base thereby providing additional flashing illumination around and above the outside of the opening of the shaped hollow plastic shell into which the base has been inserted and secured. Alternatively, the additional light emitting diodes or incandescent lamps 10 could be wired as a separate circuit in common use with the batteries 3 and handle switch mechanism of FIG. 3.

Securing the base of the illuminating means to the inside wall of a shaped hollow plastic shell may be with rivets, induction welding, a variety of adhesive means, including, without limitation, epoxy or acrylic adhesives alone or with double sided adhesive coated strips of foam or solid material or with u-shaped or hairpin clips, which clips can be incorporated as part of the base. The appropriate choice of such securing means would be readily apparent to one skilled in the art, the principal consideration being the ease of assembly of the illuminated carrier.

The type of electrical circuitry, whether parallel or series, and the choice of light emitting diodes or incandescent lamps, along their voltage requirements, for the light emitting means is determined by the size and number of dry cell batteries and the size and number of the diodes or lamps, desired to be employed. For economy of battery life and intensity of illumination of the inner wall of the hollow plastic shell, due to their directional light emission, light emitting diodes are preferred. Similarly, the preferred choice for the flashing means is a solid state electronic circuit, particularly when light emitting diodes are used for the light emitting means. When light emitting diodes are used alone or in combination with a solid state electronic circuit, a nine volt dry cell battery is preferred as the power source.

Figure 5:
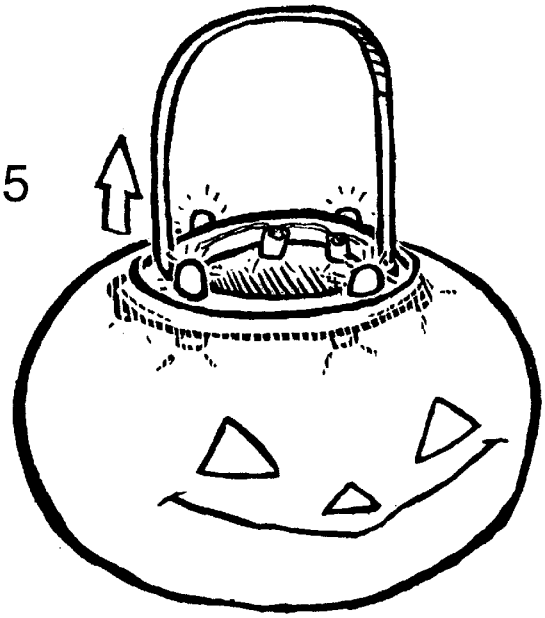
FIG. 5 is an isometric view of a jack-o-lantern employing the illuminating means of FIG. 4.

FIG. 5 shows the illuminating means illustrated in FIG. 4 inserted and secured to the inner wall of a hollow plastic shell in the shape of a jack-o-lantern. The illuminating means can be inserted into and secured within various other fancifully shaped hollow plastic shells, such as skulls or the like.

The various aspects of the invention provide a novel concept for carriers for articles such as Halloween treats and the like and provide for increased safety for children from the danger of not being seen by approaching motor vehicles.

While the present invention has been illustrated by the description of the preferred embodiments, it is not the intention of the applicant to in any way limit the scope of the appended claims. Additional modifications and advantages will be readily apparent to one skilled in the art. Therefore, the invention's scope is not to be limited to the specific described embodiments.

What is claimed:

1. An illuminating means for insertion into and securing within a shaped hollow plastic shell, said shell having an opening formed through the upper portion thereof and through which small objects may be placed in and removed from the hollow interior of said shell, said illuminating means comprising;

a truncated cone or spheroid shaped base which can be secured within the inner wall of the shaped hollow plastic shell and aligned with the opening at the upper portion of said shell and on which said base are mounted:

one or more light emitting means;

a power source;

a switch means connected to the power source for actuating said light emitting means so as to illuminate the interior wall and upper portion of said hollow plastic shell; and a handle means for carrying such shell wherein one end of said handle means forms the lift-activated terminal of the switch means and the other end of said handle means is secured to the truncated cone or spheroid shaped base.

2. The illuminating means of claim 1 wherein at least one of the light emitting means is one or more light emitting diodes.

3. The illuminating means of claim 1 wherein at least one of the light emitting means is one or more incandescent lamps.

4. The illuminating means of claims 1, 2 or 3 wherein at least one light emitting means extends above and outside of the opening at the upper portion of said shell.

5. An illuminating means for insertion into and securing within a shaped hollow plastic shell, said shell having an opening formed through the upper portion thereof and through which small objects may be placed in and removed from the hollow interior of said shell, said illuminating means comprising;

a truncated cone or spheroid shaped base which can be secured within the inner wall of the shaped hollow plastic shell and aligned with the opening at the upper portion of said shell and on which said base are mounted:

one or more light emitting means;

a power source;

a switch means connected to the power source for actuating said light emitting means so as to illuminate the interior wall and upper portion of said hollow plastic shell;

a handle means for carrying such shell wherein one end of said handle means forms the lift-activated terminal of the switch means and the other end of said handle means is secured to the truncated cone or spheroid shaped base; and a flashing means in conjoint use with at least one of the light emitting means.

6. The illuminating means of claim 5 wherein at least one of the light emitting means is one or more light emitting diodes.

7. The illuminating means of claim 5 wherein at least one of the light emitting means is one or more incandescent lamps.

8. The illuminating means of claims 5, 6 or 7 wherein the flashing means is a bi-metallic element.

9. The illuminating means of claims 5, 6 or 7 wherein the flashing means is a solid state electronic circuit.

10. The illuminating means of claims 5, 6, 7, 8 or 9 wherein at least one light emitting means extends above and outside of the opening at the upper portion of said shell.

11. An illuminated hollow carrier suitable for carrying small objects comprising, in combination:

a shaped hollow translucent plastic shell having an opening formed through the upper portion thereof through which small objects may be placed in and removed from the hollow interior; and an illuminating means inserted into and secured within said shaped hollow plastic shell, said illuminating means comprising;

a truncated cone or spheroid shaped base which can be secured within the inner wall of the shaped hollow plastic shell and aligned with the opening at the upper portion of said shell and on which said base are mounted:

one or more light emitting means;

a power source;

a switch means connected to the power source for actuating said light emitting means so as to illuminate the interior wall and upper portion of said hollow plastic shell; and a handle means for carrying such shell wherein one end of said handle means forms the lift-activated terminal of the switch means and the other end of said handle means is secured to the truncated cone or spheroid shaped base.

12. The illuminating means of claim 11 wherein at least one light emitting means extends above the opening at the upper portion of said shell.

13. The carrier claimed in claims 11 or 12 wherein said illuminating means includes a flashing means in conjoint use with at least one of the light emitting means.

14. The carrier claimed in claims 11, 12 or 13 wherein said shaped hollow translucent plastic shell is in the shape of a jack-o-lantern or other fanciful shape.

* * * * *